US008155372B2

(12) United States Patent
North

(10) Patent No.: US 8,155,372 B2
(45) Date of Patent: Apr. 10, 2012

(54) WIRE SUSPENSION FOR SPEAKERS

(76) Inventor: Donald North, Los Angeles, CA (US)

( * ) Notice: Subject to any disclaimer, the term of this patent is extended or adjusted under 35 U.S.C. 154(b) by 1244 days.

(21) Appl. No.: 11/818,726

(22) Filed: Jun. 15, 2007

(65) Prior Publication Data

US 2008/0310669 A1 Dec. 18, 2008

(51) Int. Cl.
*H04R 1/00* (2006.01)

(52) U.S. Cl. ..... 381/409; 381/410

(58) Field of Classification Search ..... 381/409–410
See application file for complete search history.

(56) References Cited

U.S. PATENT DOCUMENTS 3,819,876 A * 6/1974 Kinoshita ..... 381/407
3,828,144 A * 8/1974 Yamamuro et al. ..... 381/162
3,870,833 A * 3/1975 Kinoshita ..... 381/409
3,909,557 A * 9/1975 Kinoshita et al. ..... 381/403

* cited by examiner

*Primary Examiner* — Richard A. Booth
(74) *Attorney, Agent, or Firm* — Fox Rothschild LLP

(57) ABSTRACT

The present invention relates generally to a compact speaker with secondary wire suspension. The secondary suspension assembly is the speaker has a suspension assembly with preferably 3 wires which provide stability to reduce wobbling while maintaining linear excursion.

11 Claims, 2 Drawing Sheets

WIRE SUSPENSION FOR SPEAKERS

BACKGROUND OF THE INVENTION

1. Field of the Invention

The present invention relates generally to a suspension assembly for speakers. Specifically, this invention teaches a suspension assembly that provides greater stability, including at maximum diaphragm excursions, thus translating into greater volume output, increased frequency range and refined sound reproduction.

2. Background Information

A traditional speaker design is comprised of a diaphragm, a motor assembly, and one or two suspension assemblies. The magnet, voice coil, pole and the structures supporting these components comprise the motor assembly. Sound from a speaker is generated from the application of an electric signal to the voice coil, causing an electric field from the voice coil which crosses magnetic flux from the magnet assembly. This cross product of the electric field with the magnetic field causes axial movement of the voice coil and speaker's diaphragm along an axis orthogonal to the plane of the diaphragm.

A traditional speaker suspension controls and ultimately limits the movement of the diaphragm along the pole. A typical speaker includes two suspensions: one primary and one secondary. The primary suspension couples the outer circumference of the diaphragm to the speaker frame. The secondary suspension, axially spaced behind the primary suspension, couples the voice coil to the speaker frame.

The two suspensions work together to maintain linear movement characteristics, also known as excursion, of the voice coil and diaphragm. Since the diaphragm is connected to the voice coil, the diaphragm's movement generates air pressure and, ultimately, sound. It is important to maintain linear excursion of the diaphragm along the pole in order to minimize instability in diaphragm movement and to allow the rapid movements that generate a wide range of frequencies.

The typical audible frequency range for human ears is between 20 to 20,000 hertz. In order to generate a 20 hertz frequency, a diaphragm has to move 20 times per second. Similarly, to generate a 20,000 frequency, a diaphragm has to move 20,000 times per second.

The sound pressure level of a speaker is determined by the surface area of the diaphragm and by the amount of excursion per vibration. In other words, the more air that is pushed by the diaphragm's movement, the louder the sound generated. To maintain a constant sound pressure level, a speaker diaphragm needs to move 4 times the excursion for every halving of frequency.

A traditional speaker design is constrained by the fact that it is very difficult to produce a single speaker capable of producing the entire range of audible frequency. In order to generate subsonic frequencies near or about 20 hertz, a speaker needs to have a diaphragm large enough to capture and move a lot of air at once to generate the subsonic tones. Accordingly, low frequency speakers tend to be large in size to meet the volumetric requirements and have stiff and heavy diaphragms to prevent buckling under high excursion demands. Such low-frequency speakers are also commonly referred to as woofers.

Woofers, when asked to produce high frequencies, will not be able to move fast enough to generate frequencies anywhere near 20,000 hertz because of the mass, weight, and stiffness of its diaphragm. Accordingly, speakers designed for reproduction of high-frequency sounds, or tweeters, tend to have small diaphragms, low mass and minimal inertia so that it can vibrate at frequencies close to or above audible frequency range.

A typical tweeter or compact speaker has a diaphragm with a diameter between 0.5 to 2 inches and contains very low mass so that it can vibrate at high velocity. However, because a tweeter does not need to have a high excursion to generate audible sound and also has a lesser need for maintaining linearity in movement as a result of the low excursion, most tweeters forego the second suspension. While this typical design is suitable for speaker assemblies which incorporate separate woofers and/or midrange speakers, many speaker assemblies do not have space for a woofer or mid-range speaker. This is the case with the advent of many portable consumer goods, including devices such as ipods, hands-free mobile phones and computer laptops.

In devices with limited space in which compact speakers are used as the main speakers, mid to low frequency response is diminished due to the limited frequency range of a typical compact speaker design and its lack of a secondary suspension. Without a secondary suspension, the diaphragm movement is susceptible to significant wobbling at high excursion. The wobbling can affect the volume output and distort the sound output, thereby limiting the audible range and application of a tweeter.

In order to increase frequency range and reduce wobbling the present invention discloses a secondary wire suspension assembly for compact speakers. The additional wire suspension helps maintain linearity in diaphragm movement and provides greater stability at maximum diaphragm excursion, translating into greater volume output, increased frequency range and finer sound reproduction. The secondary wire suspension can also be used to conduct electricity to the voice coil.

From the preceding descriptions, it is apparent that the devices currently being used have significant disadvantages and/or limitations. Thus, important aspects of the technology used in the field of invention remain amenable to useful refinement.

SUMMARY OF THE INVENTION

The present invention relates to a speaker that satisfies the need for a secondary suspension assembly for compact speakers. In one preferred embodiment, a secondary suspension assembly on a speaker having features of the present invention comprises at least 3 tinsel wires separated 120 degrees apart at the outer diameter of the voice coil's bobbin. The use of evenly-spaced tinsel wire around the bobbin of the voice coil helps maintain linearity in voice coil and diaphragm movement and provides greater stability at maximum diaphragm excursion, translating into greater volume output, increased frequency range and greater accuracy in sound reproduction.

All of the foregoing operational principles and advantages of the present invention will be more fully appreciated upon consideration of the following detailed description with reference to the drawings.

BRIEF DESCRIPTION OF THE DRAWINGS

The features and advantages of this invention are better understood with regard to the following drawings, description, and claims. The drawings consist of the following:

DETAILED DESCRIPTION OF THE INVENTION

The essential elements of a speaker are a diaphragm 1, a motor assembly 2, and a suspension assembly. The motor assembly is comprised of a magnet, voice coil, pole and the structures supporting these components. These structures can be of any sort commonly known to those skilled in the art and are thus not described herein.

Figure 1:
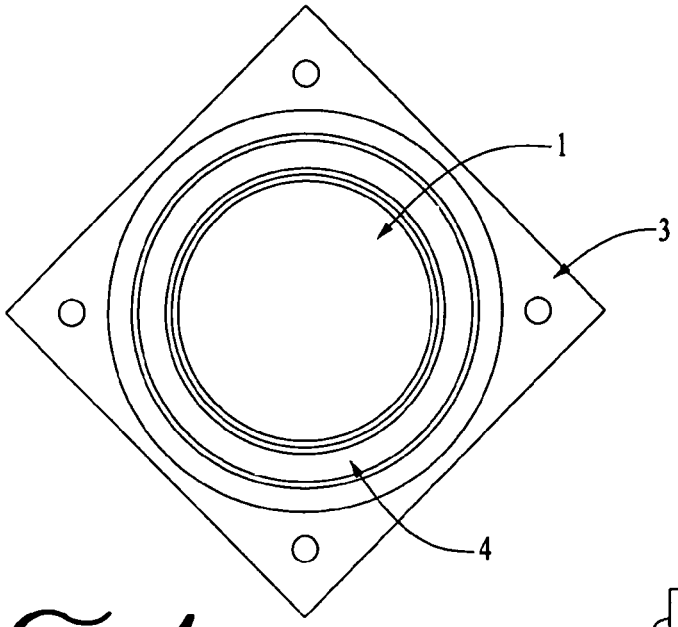
FIG. 1 is a top plan view of a speaker embodying features of this invention.
Figure 2:
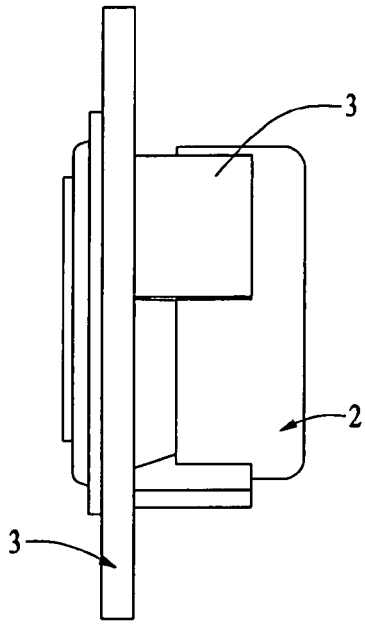
FIG. 2 is a side view of a speaker embodying features of this invention.

This invention discloses a speaker with a secondary suspension comprised of three wires as disclosed in the preferred embodiment illustrated in FIGS. 1-6. As seen in FIGS. 1 and 2, a diaphragm 1 is coupled to a speaker frame 3 via a primary suspension 4. The speaker frame 3 serves as the chassis to which all components of a speaker are coupled to in some fashion.

Figure 3:
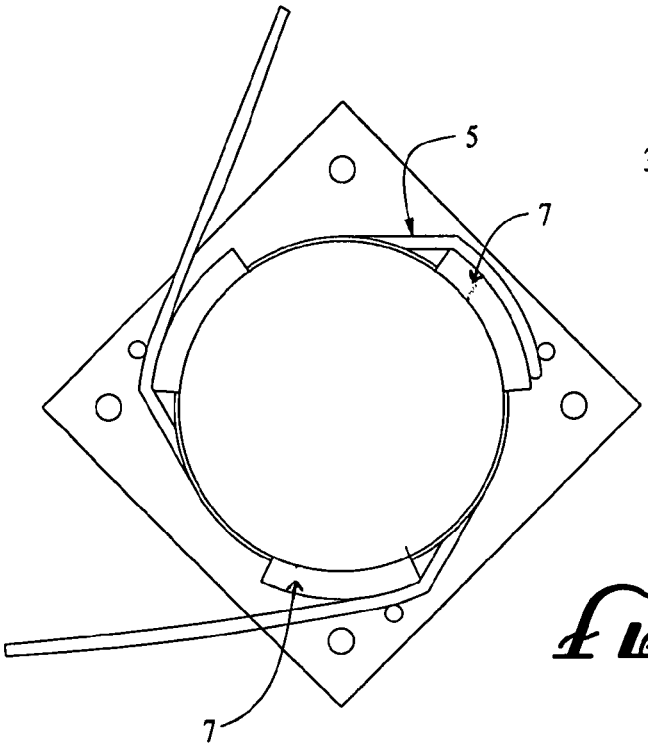
FIG. 3 is a bottom plan view of a speaker embodying features of this invention.
Figure 4:
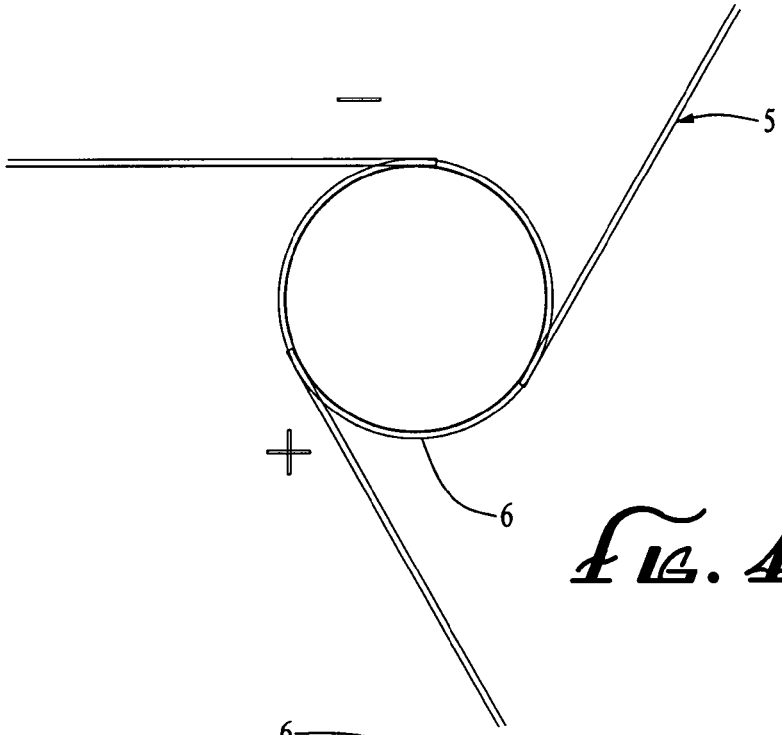
FIG. 4 is a top plan view of a speaker embodying features of this invention.
Figure 5:
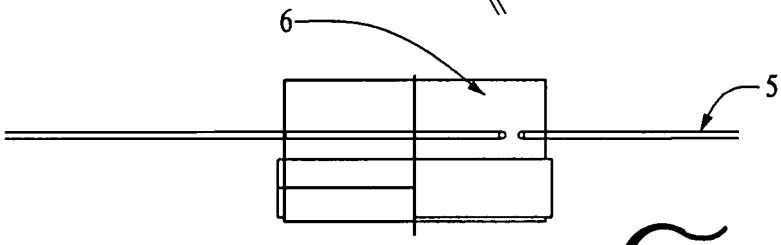
FIG. 5 is a side view of a speaker embodying features of this invention.
Figure 6:
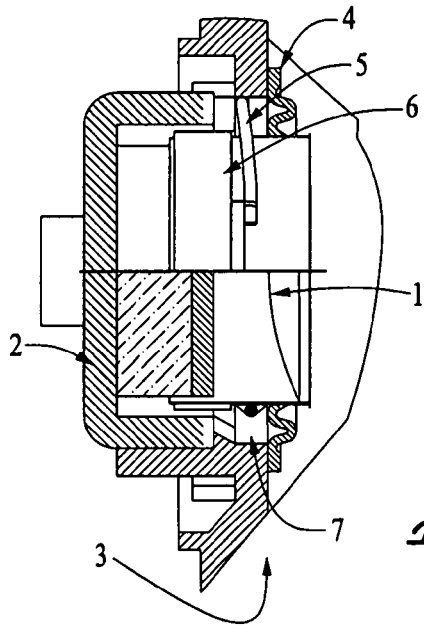
FIG. 6 is a cross-sectional side view of a speaker embodying features of this invention.

FIG. 3 discloses a secondary suspension comprised of three wires 5 made of a flexible conductive metal, such as tinsel wire or braided wire which provide sufficient support to reduce wobbling while also retaining an amount of flexibility for linear excursion. One conductive wire is capable of carrying a positive charge. Another conductive wire is capable of carrying a negative charge. These two wires charge the coil leading to fluxes in polarity.

The three wires 5 wrap around and couple to the voice coil 6 with adhesive, and are secured on the other end via an anchor 7 which is preferably an extension of the frame 3. The three wires are preferably arranged at equal distances apart at 120 degrees. (See FIGS. 4 and 5.) The wires between the voice coil 6 and the anchor 7 contain a minimal amount of free-play so as not to restrict the voice coil 6 and therefore the diaphragm's 1 excursion axially.

The anchors 7 provides leverage as the wires 5 are preferably looped through them to ensure equal tension for the wires between the voice coil 6 and the anchor 7. While the wires 5 are preferably secured to anchors 7 on the frame 3, other embodiments include securing the wires on other external structures commonly known to those skilled in the art.

Although this preferred embodiment discloses 3 wires, it is possible to use 2 wires for the suspension, though the support may not be as stable. More than 3 wires may also be used which may further improve stability but at the expense of increased moving mass, suspension stiffness, and cost.

Although the present invention has been described in detail with respect to certain preferred versions thereof, other versions are possible. Therefore, the scope of the claims should not be limited to the description of the preferred versions contained herein.

The invention claimed is:

1. A speaker comprising:

(a) a diaphragm;

(b) a primary suspension coupled to said diaphragm;

(c) a motor assembly;

(d) a secondary suspension assembly; and (e) a speaker frame, wherein said secondary suspension assembly is located within the speaker and comprises at least 3 wires wherein said wires are coupled to the voice coil and an anchor, wherein said anchor is located within the speaker.

2. The speaker of claim 1, wherein said anchor is an extension of the speaker frame.

3. The speaker of claim 1, wherein the wires are conductive and capable of carrying a charge, and at least one wire is capable of carrying a positive charge, and at least one wire is capable of carrying a negative charge.

4. The wires of claim 1, wherein said wires maintain linearity in the diaphragm movement and provide sufficient support to decrease wobbling of the diaphragm.

5. The wires of claim 1, wherein said wire is a tinsel wire, a braided wire, or any combination thereof.

6. The speaker of claim 1, wherein the wires are arranged at an equal distance apart at 120 degrees, and wherein the wires between the voice coil and the anchor contain a minimal amount of free-play to not restrict the voice coil and retain an amount of flexibility for linear excursion.

7. The speaker of claim 1, wherein the secondary assembly consists of 3 wires, wherein each wire is partially wrapped around the voice coil and coupled to the voice coil.

8. The speaker of claim 1, wherein the anchor is coupled to the internal portion of the speaker frame and adjacent to the voice coil.

9. The speaker of claim 1, wherein the speaker is capable of producing sound in the audible range between 300 hertz to 20,000 hertz.

10. The speaker of claim 1, wherein the speaker is a compact speaker.

11. The secondary suspension assembly of claim 1, wherein said wires are tangential to the circumference of the voice coil and coupled to the voice coil.

* * * * *